US009476148B2

(12) United States Patent
Riaz

(10) Patent No.: US 9,476,148 B2
(45) Date of Patent: Oct. 25, 2016

(54) SOCK TOE CONSTRUCTION

(71) Applicant: Interloop Limited, Faisalabad (PK)

(72) Inventor: Yaser Riaz, Faisalabad (PK)

(73) Assignee: INTERLOOP LIMITED, Faisalabad (PK)

( * ) Notice: Subject to any disclaimer, the term of this patent is extended or adjusted under 35 U.S.C. 154(b) by 342 days.

(21) Appl. No.: 14/152,632

(22) Filed: Jan. 10, 2014

(65) Prior Publication Data

US 2015/0082836 A1 Mar. 26, 2015

(30) Foreign Application Priority Data

Sep. 20, 2013 (PK) ..... 651/2013
Sep. 20, 2013 (PK) ..... 16881-D/2013

(51) Int. Cl.
*D04B 1/26* (2006.01)
*D04B 21/20* (2006.01)

(52) U.S. Cl.
CPC ..... *D04B 1/26* (2013.01); *D04B 21/207* (2013.01)

(58) Field of Classification Search
CPC ..... D04B 1/26; D04B 21/207
USPC ..... 66/186, 187
See application file for complete search history.

(56) References Cited

U.S. PATENT DOCUMENTS 234,074 A * 11/1880 Scott ..... D04B 1/26 2/239
450,655 A * 4/1891 White ..... D04B 1/26 66/187
1,117,934 A 11/1914 West
2,926,513 A * 3/1960 Tew ..... D04B 1/108 66/187
3,367,144 A 2/1968 McGinty et al.
6,000,247 A * 12/1999 Takeda ..... A41B 11/00 2/239
6,021,527 A 2/2000 Lessard
6,292,951 B1 9/2001 Kalde
6,481,245 B1 11/2002 Kalde
6,935,141 B2 * 8/2005 Takeda ..... A41B 11/00 66/187
7,437,896 B2 * 10/2008 Hirao ..... A41B 11/00 2/239
7,971,280 B2 7/2011 Kaneda (Continued)

FOREIGN PATENT DOCUMENTS

EP 1 731 046 12/2006
EP 002426643-0001 3/2014

(Continued)

OTHER PUBLICATIONS

Extended European Search Report corresponding to European Patent Application No. 14160292.0 dated Mar. 21, 2015.

(Continued)

*Primary Examiner* — Danny Worrell
(74) *Attorney, Agent, or Firm* — Jenkins, Wilson, Taylor & Hunt, P.A.

(57) ABSTRACT

A knitted sock includes a specially shaped toe with multiple gores and extra fabric length to cover portions of a wearer's toe digits, permitting the sock to assume a relaxed form with reduction of pressure on or along a wearer's toe digits. A sock toe portion may include left and right side boundaries, a first left side gore proximate to the left side boundary, a second left side gore distanced (e.g., inset) from and non-intersecting with the first left side gore, a first right side gore proximate to the right side boundary, and a second right side gore distanced (e.g., inset) from and non-intersecting with the first right side gore.

23 Claims, 5 Drawing Sheets

(56) References Cited

U.S. PATENT DOCUMENTS

| | | | |
|---|---|---|---|
| 8,418,507 | B2 | 4/2013 | Beckler et al. |
| 8,495,765 | B2 | 7/2013 | Araki et al. |
| 8,572,766 | B2 | 11/2013 | Shull et al. |

FOREIGN PATENT DOCUMENTS

| | | |
|---|---|---|
| EP | 002426643-0002 | 3/2014 |
| EP | 002426643-0003 | 3/2014 |
| EP | 002426643-0004 | 3/2014 |
| EP | 2 865 798 | 4/2015 |

OTHER PUBLICATIONS

Asics, "Kayano® Classic Low Cut" webpage, accessible at http://www.asicsamerica.com/Shop/Accessories/Running/Kayano%C2%AE-Classic-Low-Cut/p/0010144110.0193, accessed on Mar. 24, 2014.

Sock Geek, "Left and Right Fit Running Socks" webpage, accessible at http://www.sockgeek.com/c-14-leftright-fit-socks.aspx, accessed on Mar. 24, 2014.

* cited by examiner

SOCK TOE CONSTRUCTION

CROSS-REFERENCE TO RELATED APPLICATION(S)

This application claims benefit of Pakistani Patent Application No. 651/2013 filed on Sep. 20, 2013 entitled "SPECIAL TOE CONSTRUCTION" and of Pakistani Design Application No. 16881-D/2013 filed on Sep. 20, 2013 entitled "SPECIAL SOCKS TOE." Priority of the foregoing Pakistani applications is hereby claimed under 35 U.S.C. 119, and the contents of such applications are hereby incorporated by reference herein, for all purposes.

TECHNICAL FIELD

The innovation covers the field of legwear, more particularly the technical sock category used by athletes and people living active lifestyles.

BACKGROUND

Circular knitting sock machines are commercial available and use a system of needles and yarn feeders to knit a sock in a tubular shape. Needles are arranged in a circle and may be sequentially actuated, whereby stitches may be sequentially added in a circle to add rows of stiches to the tube of a sock. If every needle in the circle adds a stitch, then a full circle of stiches is formed and adds a full circular row to the tube.

It is known to provide additional shapes to a sock, such as angles and pockets, including in the heel and toe areas, by actuating only certain groups of needles in the circle of a circular knitting machine. The needles that are actuated add a stitch, while those needles that are not actuated do not add stitches, thereby adding partial rows only on the side of the sock that is actuated. For example, if a heel is being added, then only the part of the circle that makes up the heel is actuated (so that rows of stitches are added only on that side, while the remainder of the sock remains the same length. Since the machine knots only on one side of the sock, extra material is added on that side to create a bend. This process adds extra material in a portion of the sock to increase is length, thereby forming a heel.

An anomaly in the stitching pattern occurs every time a partial row is added. These odd-stitches create a line in the sock, known as a "gore." A standard gore occurs in a straight line, with one gore typically located in the heel of a sock, and another gore typically located in the toe of the sock.

A typical toe gore occurs in a straight line along corners of a toe region of a sock. Use of such as gore is the means by which a knotting machine joins corner material of the sock and closes its edge. The gore closure allows a sock toe to have a curved shaped instead of a squared-off appearance, and also prevents excess material in edges of the sock, thereby enhancing comfort of the wearer.

A more complicated pattern occurs when a Y-shaped gore is formed—whether at a heel or toe of a sock. A Y-shaped gore line provides additional room by giving an added dimension of depth. When provided at a toe of a sock, a Y-shaped gore allows a knitter to decrease a horizontal dimension of the toe while permitting increased expansion to accommodate expansion along toes of a wearer. Use of Y-shaped gores along heel and toe portions of socks are disclosed by U.S. Pat. No. 8,418,507.

Whether straight or Y-shaped gores are used along toe portions of socks, the resulting socks embody substantially envelope-shaped toe portions to fit a wearer's forefoot. The front curve of the wearer's toe digits is therefore accommodated only by stretching of knitted fabric, which exerts consistent pressure on the wearer's toes. It would be desirable to provide socks that confer greater comfort to a wearer with reduction of pressure along the wearer's toes while avoiding excess material along sock edges.

SUMMARY

Various aspects of the invention relate to a sock with a knitted toe portion including multiple gores and knitting of extra fabric length arranged to cover portions of a wearer's toe digits, permitting the sock to assume a relaxed form with reduction of pressure on or along a wearer's toe digits.

In one aspect, the invention relates to a sock arranged to receive a foot and toes of a user, the sock comprising a knitted toe portion including a left side boundary, a right side boundary, a first left side gore proximate to the left side boundary, a second left side gore distanced from and non-intersecting with the first left side gore, a first right side gore proximate to the right side boundary, and a second right side gore distanced from and non-intersecting with the first right side gore.

In another aspect, the invention relates to a sock arranged to receive a foot and toes of a user, the sock comprising: a knitted toe portion including an upper toe region arranged to contact top surfaces of the user's toes; first left side gore; a second left side gore inset from, and non-intersecting with, the first left side gore; a first right side gore; and a second right side gore inset from, and non-intersecting with, the first right side gore; wherein the upper toe region is laterally bounded along portions thereof between the second left side gore and the second right side gore.

In a further aspect, any of the foregoing aspects, and/or features and elements as disclosed herein, may be combined for additional advantage.

Other aspects, features, and embodiments of the invention will be more fully apparent from the ensuing disclosure and appended claims.

DETAILED DESCRIPTION

Figure 1:
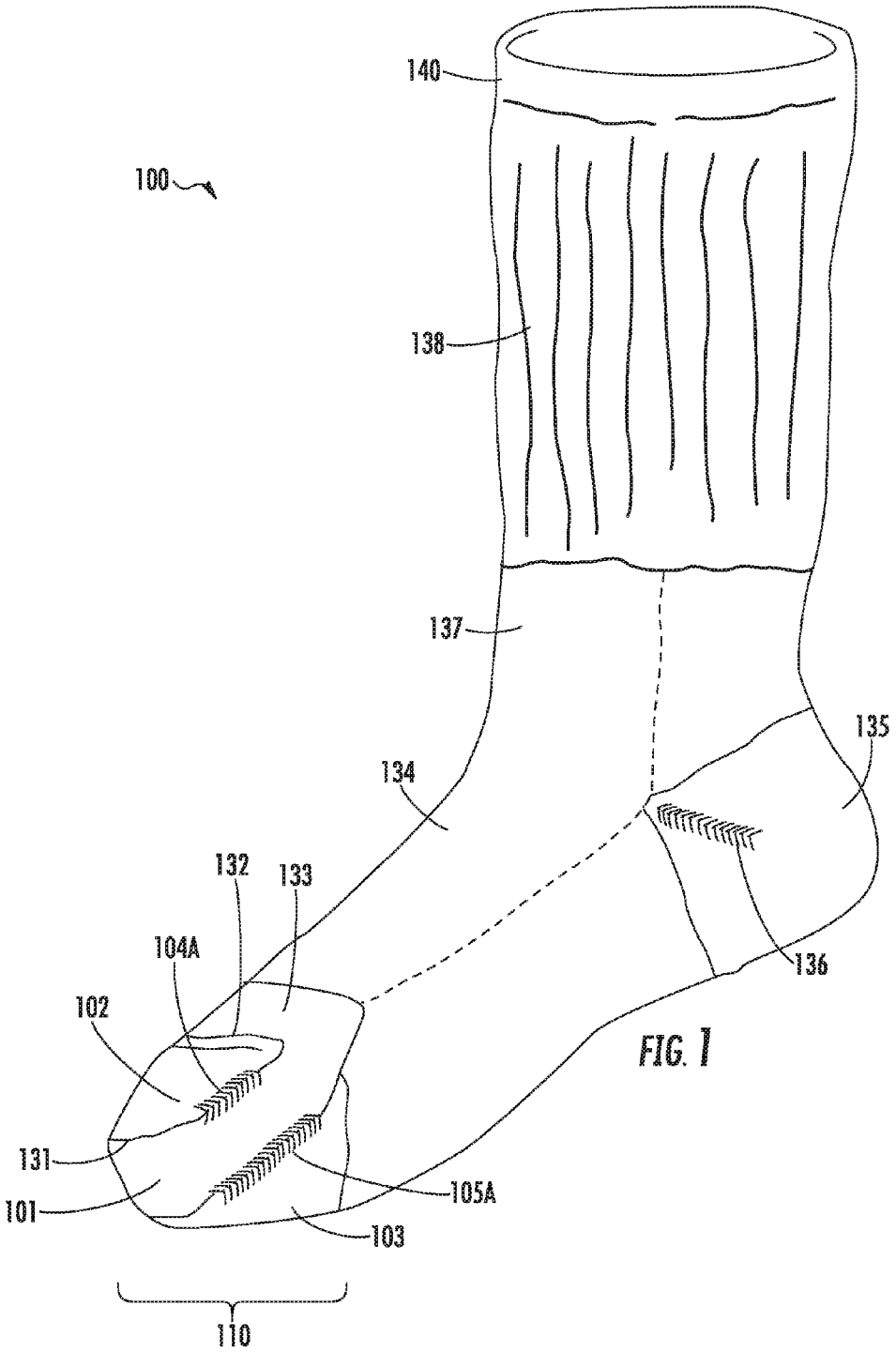
FIG. 1 is a left side elevation view of a sock including a specially shaped toe according to one embodiment of the present invention.

The invention relates to a novel sock with a specially fabricated and shaped toe portion as well as a process of making such a special shaped toe via knitting. The specially shaped toe portion can be made in plain or pile fabrics. The novel sock toe is knitted in such a way that an extra fabric length is knitted and vertically covers the tips of a user's toes, with the sock thereby taking a natural toe shape in a relaxed form. The additional fabric along a sock toe portion in the case of a terry construction also provides better cushioning on frontal impact in situations such as running or kicking.

In certain embodiments, a sock is arranged to receive a foot and toes of a user, the sock comprising a knitted toe portion including a left side boundary, a right side boundary, a first left side gore proximate to the left side boundary, a second left side gore distanced from and non-intersecting with the first left side gore, a first right side gore proximate to the right side boundary, and a second right side gore distanced from and non-intersecting with the first right side gore.

In certain embodiments, a sock is arranged to receive a foot and toes of a user, the sock comprising: a knitted toe portion including an upper toe region arranged to contact top surfaces of the user's toes; first left side gore; a second left side gore inset from, and non-intersecting with, the first left side gore; a first right side gore; and a second right side gore inset from, and non-intersecting with, the first right side gore; wherein the upper toe region is laterally bounded along portions thereof between the second left side gore and the second right side gore.

In certain embodiments, the upper toe region is knitted.

In certain embodiments, at least a portion of the first left side gore is substantially parallel to at least a portion of the second left side gore, and wherein at least a portion of the first right side gore is substantially parallel to at least a portion of the second right side gore.

In certain embodiments, a knitted toe portion comprises an upper toe region arranged to contact top surfaces of the user's toes, wherein the upper toe region is laterally bounded along portions thereof by the second left side gore and the second right side gore.

In certain embodiments, a lateral edge, gore, or seam may extend from the second left side gore to the second right side gore and further define a rear boundary of the upper toe region.

The upper toe region may comprise any of various desirable shapes. In certain embodiments, an upper toe region comprises a substantially crescent-shaped form. In certain embodiments, an upper toe region comprises a substantially annular crescent-shaped form.

In certain embodiments, a knitted toe portion comprises a knitted upper panel portion and a knitted lower toe portion that separated along at least a partial boundary thereof by the first left side gore and the second left side gore, wherein the upper toe region is circumscribed within the upper panel portion.

In certain embodiments, an upper half of the knitted toe portion accommodates greater volume than a lower half of the knitted toe portion.

In certain embodiments, substantially the knitted toe portion comprises pile fabric. In certain embodiments, substantially the knitted toe portion comprises terry fabric.

In certain embodiments, a knitted toe portion of a sock is devoid of any Y-shaped gore.

Figure 2:
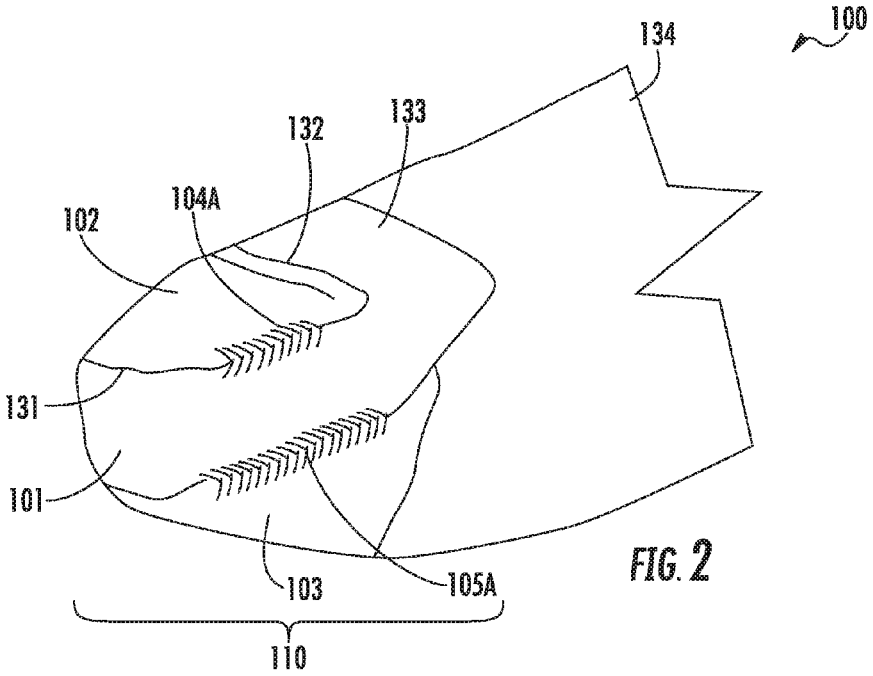
FIG. 2 is a magnified left side elevation view of a toe portion of the sock according to the embodiment of FIG. 1.
Figure 3:
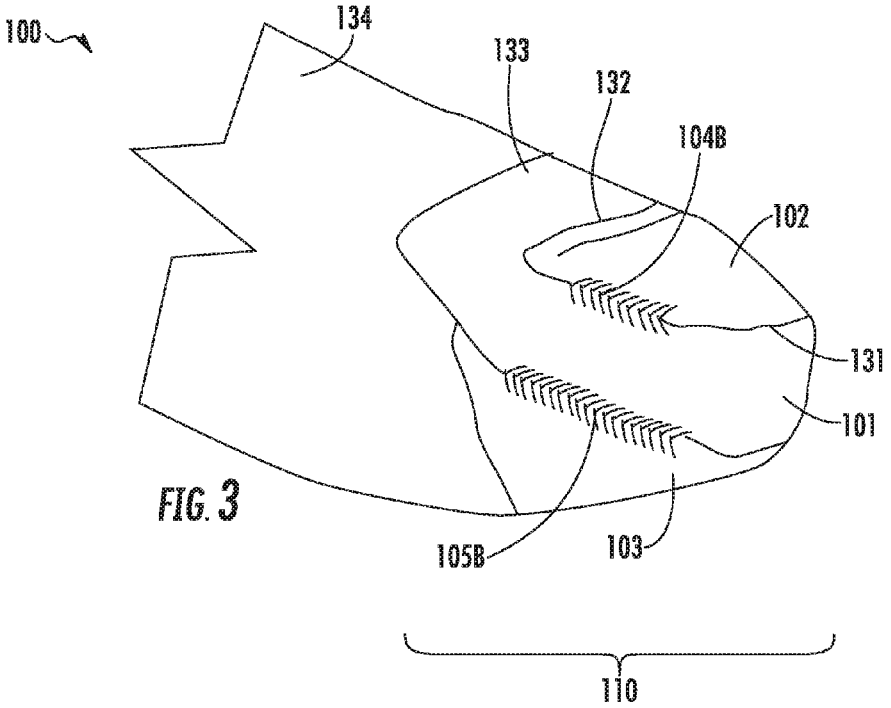
FIG. 3 is a magnified left side elevation view of the toe portion of the sock of FIG. 2.

FIG. 1 illustrates a left side of a first sock 100 with a specialized toe portion 110, including toe tip portion 101, an upper toe region 102, a lower toe portion 103, a first left side (upper) gore 104A, and a second left side (lower) gore 105A. The sock 100 further includes a tubular mid-foot portion 134, a heel portion 135 with associated gore 136, a tubular ankle portion 137 extending above the heel portion 135, and a ribbed calf portion 138, and an elasticized end 140. The lower toe portion 103 is arranged to contact lower surfaces of a user's toe digits. A magnified left side view of part of the sock 100 including the toe portion 110 is shown in FIG. 2, and a magnified right side view of part of the sock 100 including the toe portion 110 is shown in FIG. 3. As shown in FIGS. 1 and 2, the first left side gore 104A is arranged proximate to a left side boundary of the knitted toe portion 110, and the second left side gore 105A is distanced from (i.e., inset from), and non-intersecting with, the first left side gore 104A. The upper toe region 102 is arranged to contact top surfaces of toe digits of a user (wearer), and the toe tip portion 101 is arranged to contact front surfaces of toe digits of a user (wearer), when the user's foot is arranged within the sock. As shown in FIG. 3, the first right side gore 104B is arranged proximate to a right side boundary of the knitted toe portion 110, and the second right side gore 105B is distanced from (i.e., inset from), and non-intersecting with, the first right side gore 104B.

As shown in FIGS. 1-3, the upper toe region 102 is laterally bounded along portions thereof by the first left side gore 104A and the first right side gore 104B. The upper toe region 102 may be further bounded (i.e., along a rear boundary) by a lateral edge, seam or lateral gore (or gore extension) 132 that extends between the first left side gore 104A and the first right side gore 104B, and the upper toe region 102 may be further bounded by a front edge, seam, or gore (or gore extension) 131 similarly extending between the first left side gore 104A and the first right side gore 104B.

As shown in FIGS. 1-3, the upper toe region 102 is laterally bounded along portions thereof by the first left side gore 104A and the first right side gore 104B. The upper toe region 102 may be further bounded (i.e., along a rear boundary) by a lateral edge, seam or lateral gore (or gore extension) 132 that extends between the second left side gore 104A and the second right side gore 1048, and the upper toe region 102 may be further bounded by a front edge, seam, or gore (or gore extension) 131 similarly extending between the second left side gore 104A and the second right side gore 104B.

As shown in FIGS. 1-3, a rearward extension 133 of the toe tip portion 101 may extend laterally behind the upper toe region 102, with the toe tip portion 101 and upper toe region 102 in combination constituting an upper panel portion, and the upper toe region 102 may be circumscribed within the upper panel portion constituted of the toe tip portion 101 and the rearward extension 133. As shown in FIGS. 1-3, the upper toe region 102 may embody a substantially crescent-shaped form.

Figure 4:
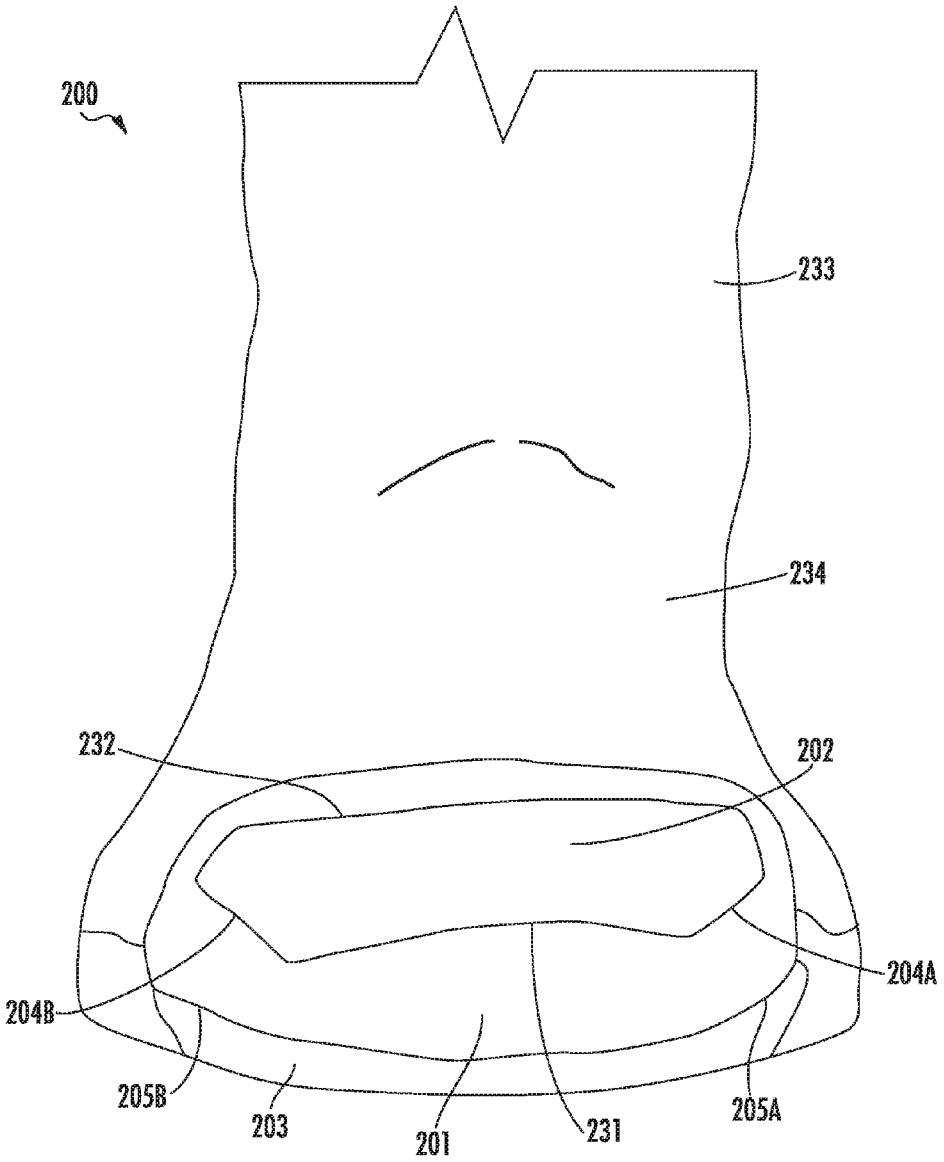
FIG. 4 is a front elevation view of a sock including a specially shaped toe according to one embodiment of the present invention.

FIG. 4 illustrates a sock 200 according to another embodiment of the present invention, with a specialized toe portion 210 including a toe tip portion 201, an upper toe region 202, a lower toe region 203, a first left side (lower) gore 205A, a second left side (upper gore) 204A, a first right side (lower) gore 205B, a second right side (upper) gore 205A, a mid-foot portion 234, and an ankle portion 233. The upper toe region 202 is laterally bounded along portions thereof by the first left side gore 204A and the first right side gore 204B.

The upper toe region 202 may be further bounded (i.e., along a rear boundary) by a lateral edge, seam or lateral gore (or gore extension) 232 that extends between the second left side gore 204A and the second right side gore 204B, and the upper toe region 202 may be further bounded by a front edge, seam, or gore (or gore extension) 231 similarly extending between the second left side gore 204A and the second right side gore 204B. The sock 200 illustrated in FIG. 4 is substantially similar to the sock 100 shown in FIGS. 1-3, except that the sock 200 includes an upper toe region 202 resembling an annular sector shape (i.e., resembling a sector of a doughnut).

By providing multiple non-intersecting gores along each side of a toe portion of a sock, with an upper toe region having increased fabric, an upper half of the knitted toe portion accommodates greater volume than a lower half of the knitted toe portion—thereby permitting the sock to assume a relaxed form with reduction of pressure on or along a wearer's toe digits.

Figure 5:
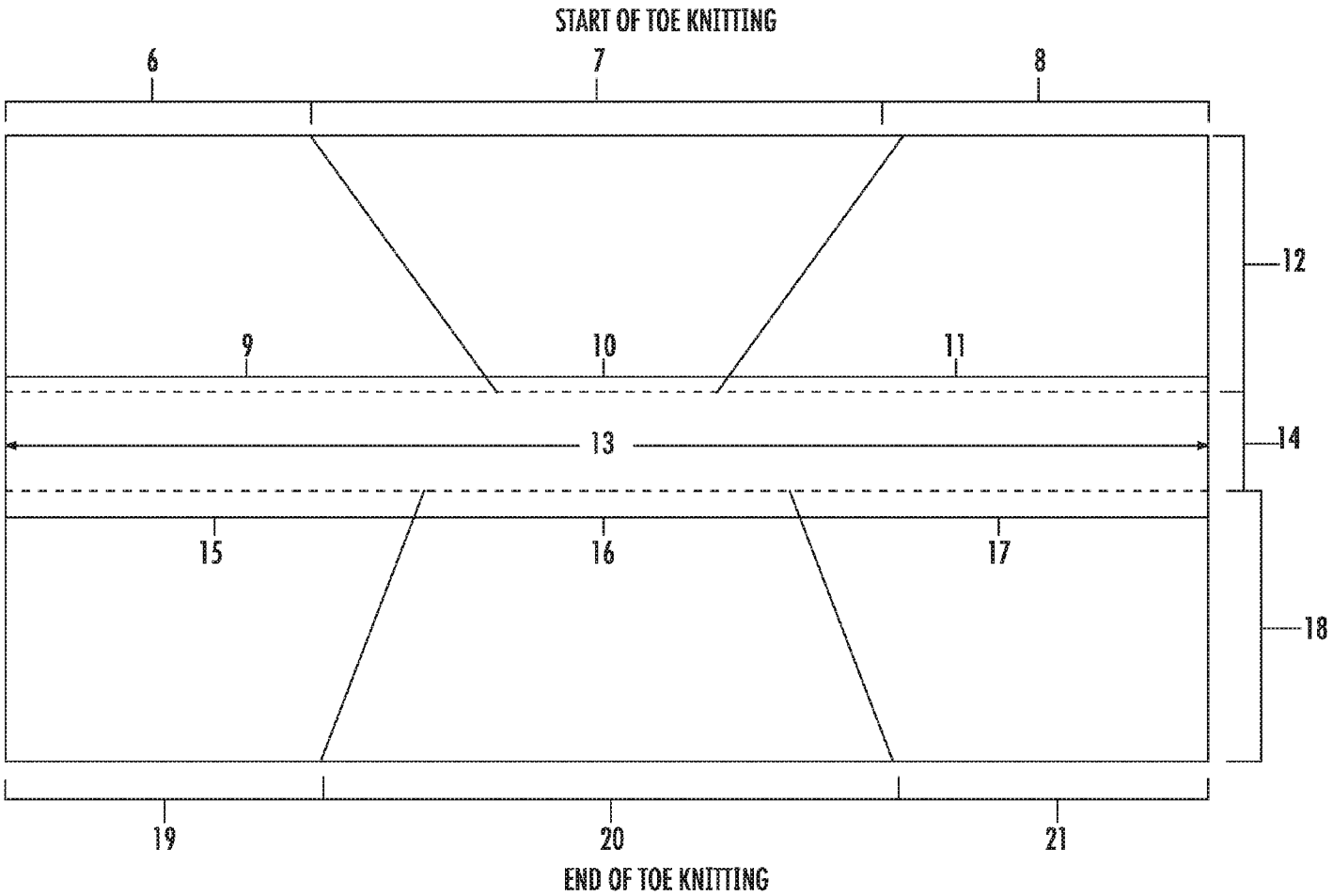
FIG. 5 is a knitting diagram for forming a specially shaped toe of a sock according to embodiments of the present invention.

The description of the following FIG. 5 makes reference to a particular knitting machine needle count in order to explain the knitting function, but the socks and production technique disclosed herein are neither limited nor restricted to any needle count and can be made utilizing any commercially available needle count.

Figure 6:
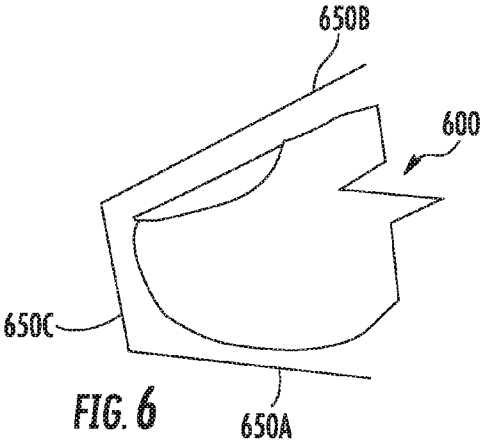
FIG. 6 is a side schematic view of an end portion of a human toe, with illustration of three lines arranged tangentially along external boundaries of the toe.
Figure 7:
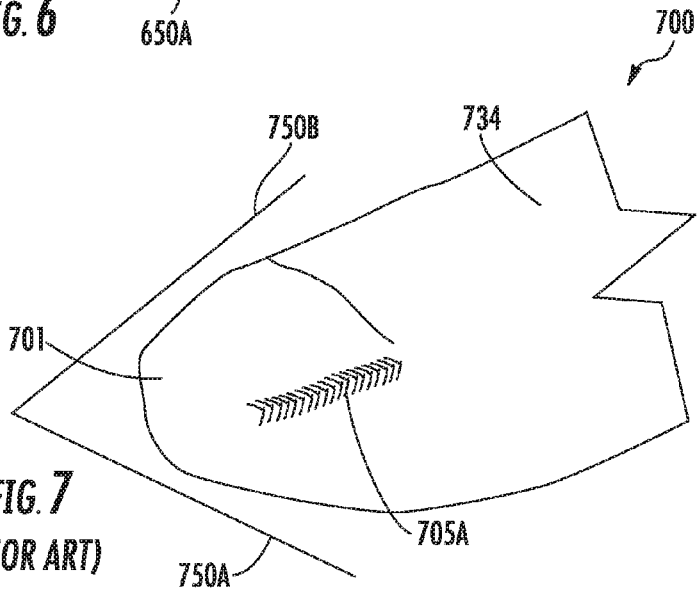
FIG. 7 (PRIOR ART)
FIG. 7 is a side schematic view of an end portion of a conventional sock including a single gore line with illustration of two intersecting lines arranged tangentially along upper and lower end portions of the sock.
Figure 8:
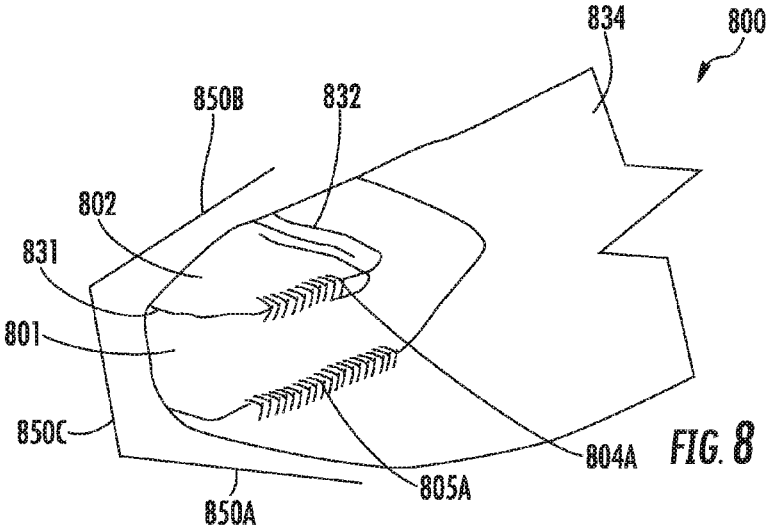
FIG. 8 is a side schematic view of an end portion of a sock with a specially shaped toe according to one embodiment of the present invention, with illustration of three lines arranged tangentially along external boundaries of the sock.

FIGS. 6-8 show a comparison of shapes between a toe digit 600, a conventional sock 700, and a sock 800 with a special toe according to an embodiment of the present invention. FIG. 6 shows that a first boundary line 650A may be drawn tangentially along a bottom surface of a toe digit, a second boundary line 650B may be drawn tangentially along an top surface of a toe digit, and a third boundary line 650C may be drawn tangentially along a front surface of a toe digit, with the first line 650A and second line 650B each arranged to intersect the third line 650C. The third line 650C represents height of a front portion of a user's toe.

FIG. 7 illustrates a toe portion of a conventional sock including a toe tip 701, a gore 705A along one lateral boundary thereof, and a tubular mid-foot portion 734. The toe tip 701 of the conventional sock resembles an envelope in shape, with top and bottom surfaces meeting at a sharply curved (i.e., low height) front boundary. A first boundary line 750A may be drawn tangentially along a bottom surface of the sock 700, and a second boundary line 750B may be drawn tangentially along a top surface of the sock 700, with the first and second boundary lines 750A, 750B arranged to intersect, and the two boundary lines 750A, 750B resembling adjacent panels of an envelope. It is apparent that when a user's foot is placed within the conventional sock 700, the toe tip 701 must stretch to accommodate the significant height of toe digits of the user.

FIG. 8 illustrates a toe portion of a sock 800 according to one embodiment of the present invention, including a toe tip portion 801, an upper toe region 802, a lower toe region 803, a first left side (lower) gore 805A, a second left side (upper gore) 804A, a first and a second right side gore (not shown, but embodying mirror images of the first and second left side gores, respectively)), and a mid-foot portion 834. The upper toe region 802 is laterally bounded along portions thereof by the first left side gore 804A and a first right side gore (not shown). The upper toe region 802 may be further bounded (i.e., along a rear boundary) by a lateral edge, seam or lateral gore (or gore extension) 832 that extends between the second left side gore 804A and the second right side gore (not shown), and the upper toe region 802 may be further bounded by a front edge, seam, or gore (or gore extension) 831 similarly extending between the second left side gore 804A and the second right side gore (not shown). A first boundary line 850A may be drawn tangentially along a bottom surface of a lower toe portion of the sock 800, a second boundary line 850B may be drawn tangentially along an top surface of the upper toe region 802, and a third boundary line 850C may be drawn tangentially along a front surface of the toe tip portion 801, with the first line 850A and second line 850B each arranged to intersect the third line 850C.

A comparison between FIGS. 6-8 shows that the overall shape of the special toe construction of the sock of FIG. 8 more closely resembles the natural shape of a user's toe digits (in FIG. 6) than the conventional toe construction of the sock of FIG. 7, whereby the novel sock of FIG. 8 may assume a relaxed form with reduction of pressure on or along a wearer's toe digits as compared to the conventional sock of FIG. 7.

FIG. 5 shows the technical drawing of the needles lifting/lowering plan for making a sock including a Special Toe construction as disclosed herein. As a first segment '12' of the Special Toe knitting starts, in the zone 6 of a first course, forty-two needles are disengaged from knitting, while in zone 7, eighty-four needles are lowered to engage and knit lower toe portion 103 (as shown in FIG. 1) of the special toe, while the remaining forty-two needles in zone 8 are also disengaged. The knitting continues through first segment 12 of the Special Toe knitting, and with every course the number of engaged needles is reduced by two until the last course is reached where in zone 9, seventy needles get disengaged, in zone 10 twenty-eight needles are left engaged which gives the lower/sole portion of special toe its desired curve for toe digits, and the remaining seventy needles in zone 11 are also left disengaged. With the start of the next course, the knitting machine steps into a second segment 14 of Special Toe knitting where all needles work in a single zone 13 and are engaged in the knitting process to make tubular knit fabric of the toe tip portion 101 (as shown in FIG. 1). In a first course of third segment 18 of the Special Toe construction, fifty-eight needles are disengaged in zone 15, while fifty-two needles are kept engaged in zone 16 to knit upper toe portion 102 (as shown in FIG. 1) of the Special Toe, while the remaining fifty-eight needles of zone 16 are also disengaged. The knitting continues through third segment 18 of the Special Toe knitting, and with every course the number of engaged needles is increased by two until the last course is reached, where in zone 19, forty-two needles remain disengaged, while eighty-four needles in zone'20 get engaged and the remaining forty-two needles of zone 21 are kept disengaged, thus completing the knitting of the Special Toe portion of a sock.

As noted previously, the special toe of a sock according to various embodiments disclosed herein has extra fabric that may be arranged (e.g., vertically) to cover the tips of toe digits to accommodate entire toe digit height (or volume) for a more comfortable fit. In certain embodiments, the special toe shape can be made in plain/jersey as well as terry fabric construction. When provided in terry material, the special toe construction provides improved cushioning as terry pile is perpendicularly located to finger toe tips. In certain embodiments, the special toe may be supplemented with a plurality of motifs knitted in toe tips (e.g., in an upper toe region). In various embodiments, each lateral toe boundary of a sock including the special toe has two separate gore lines, distanced but parallel to each other. In certain embodiments, socks including the special toe can be made with any desirable needle counts available in circular sock knitting machines.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Various combinations and sub-combinations of the structures described herein are contemplated and will be apparent to a skilled person having knowledge of this disclosure. Any of the various features and elements as disclosed herein may be combined with one or more other disclosed features and elements unless indicated to the contrary herein. Correspondingly, the invention as hereinafter claimed is intended to be broadly construed and interpreted, as including all such variations, modifications and alternative embodiments, within its scope andincluding equivalents of the claims.

What is claimed is:

1. A sock arranged to receive a foot and toes of a user, the sock comprising a knitted toe portion comprising:

an upper toe region arranged to contact top surfaces of the user's toes;

a left side boundary, a right side boundary, a first left side gore proximate to the left side boundary, a second left side gore distanced from and non-intersecting with the first left side gore, a first right side gore proximate to the right side boundary, and a second right side gore distanced from and non-intersecting with the first right side gore;

wherein the upper toe region is laterally bounded along portions thereof by the first left side gore and the first right side gore, wherein a rear boundary of the upper toe region is defined by a lateral edge, seam, gore or gore extension extending from the first left side gore to the first right side gore, wherein the upper toe region is further bounded by a front edge, seam, gore, or gore extension extending from the first left side gore to the first right side gore, and wherein the knitted toe portion is laterally symmetrical.

2. The sock according to claim 1, wherein at least a portion of the first left side gore is substantially parallel to at least a portion of the second left side gore, and wherein at least a portion of the first right side gore is substantially parallel to at least a portion of the second right side gore.

3. The sock according to claim 1, wherein the upper toe region comprises a substantially crescent-shaped form.

4. The sock according to claim 1, wherein the upper toe region comprises a substantially annular sector-shaped form.

5. The sock according to claim 1, wherein the knitted toe portion comprises a knitted upper panel portion and a knitted lower toe portion that are separated along at least a partial boundary thereof by the second left side gore and the second right side gore, and wherein the upper toe region is circumscribed within the upper panel portion.

6. The sock according to claim 1, wherein an upper half of the knitted toe portion accommodates greater volume than a lower half of the knitted toe portion.

7. The sock according to claim 1, wherein the knitted toe portion comprises at least one of pile fabric and terry fabric.

8. The sock according to claim 1, wherein the knitted toe portion is devoid of any Y-shaped gore.

9. A sock arranged to receive a foot and toes of a user, the sock comprising:

a knitted toe portion including an upper toe region arranged to contact top surfaces of the user's toes;

a first left side gore;

a second left side gore inset from, and non-intersecting with, the first left side gore;

a first right side gore; and a second right side gore inset from, and non-intersecting with, the first right side gore;

wherein the upper toe region is laterally bounded along portions thereof between the first left side gore and the first right side gore, wherein the knitted toe portion is laterally symmetrical.

10. The sock according to claim 9, wherein at least a portion of the first left side gore is substantially parallel to at least a portion of the second left side gore, and wherein at least a portion of the first right side gore is substantially parallel to at least a portion of the second right side gore.

11. The sock according to claim 9, further comprising a lateral edge, gore, or seam extending from the first left side gore to the first right side gore and further defining a rear boundary of the upper toe region.

12. The sock according to claim 9, wherein the upper toe region comprises a substantially crescent-shaped form.

13. The sock according to claim 9, wherein the upper toe region comprises a substantially annular sector-shaped form.

14. The sock according to claim 9, wherein the knitted toe portion comprises a knitted upper panel portion and a knitted lower panel portion that are separated along at least a partial boundary thereof by the second left side gore and the second right side gore, and wherein the upper toe region is circumscribed within the upper panel portion.

15. The sock according to claim 9, wherein an upper half of the knitted toe portion accommodates greater volume than a lower half of the knitted toe portion.

16. The sock according to claim 9, wherein the knitted toe portion comprises at least one of pile fabric and terry fabric.

17. The sock according to claim 9, wherein the knitted toe portion is devoid of any Y-shaped gore.

18. The sock according to claim 1, further comprising a toe tip portion arranged to contact front surfaces of the user's toe digits and including a rearward extension extending laterally behind the upper toe region.

19. The sock according to claim 1, further comprising a lower toe portion arranged to contact lower surfaces of the user's toe digits and adjoined by the second right side gore and the second left side gore.

20. The sock according to claim 1, wherein the first left and right side gores have a shorter length than the second left and right side gores.

21. The sock according to claim 9, further comprising a toe tip portion arranged to contact front surfaces of the user's toe digits and including a rearward extension extending laterally behind the upper toe region.

22. The sock according to claim 9, further comprising a lower toe portion arranged to contact lower surfaces of the user's toe digits and adjoined by the second right side gore and the second left side gore.

23. The sock according to claim 9, wherein the first left and right side gores have a shorter length than the second left and right side gores.

* * * * *